US005349785A

United States Patent [19]

Nickels, Jr. et al.

[11] Patent Number: 5,349,785

[45] Date of Patent: Sep. 27, 1994

[54] MOTOR SUPPORT FOR ORBITAL POLISHER

[75] Inventors: Richard C. Nickels, Jr., Hampstead, Md.; David M. Rider, Bethlehem, Pa.

[73] Assignee: Black & Decker Inc., Newark, Del.

[21] Appl. No.: 983,791

[22] Filed: Nov. 30, 1992

[51] Int. Cl.[5] ..... B24B 23/00

[52] U.S. Cl. ..... 451/357; 15/97.1

[58] Field of Search ..... 51/170 MT, 170 R, 170 T, 51/174, 177; 15/97.1, 49.1, 22.1, 28

[56] References Cited

U.S. PATENT DOCUMENTS

| | | | |
|---|---|---|---|
| 3,520,090 | 7/1970 | Lee | 51/170 |
| 3,617,786 | 11/1971 | Stielper | 310/242 |
| 4,188,682 | 2/1980 | Burglin et al. | 51/170 MT |
| 4,342,929 | 8/1982 | Horne | 310/43 |
| 4,491,752 | 1/1985 | O'Hara et al. | 310/71 |
| 4,791,694 | 12/1988 | Itaya et al. | 51/170 MT |
| 4,885,496 | 12/1989 | Wheeler | 310/254 |
| 4,910,420 | 3/1990 | Hoover et al. | 310/68 B |
| 4,934,041 | 6/1990 | Hoover et al. | 29/596 |
| 5,023,999 | 6/1991 | Looper et al. | 30/390 |

FOREIGN PATENT DOCUMENTS

| | | |
|---|---|---|
| 0138655 | 4/1985 | European Pat. Off. . |
| 1514295 | 6/1978 | United Kingdom . |
| 1543352 | 4/1979 | United Kingdom . |
| 2019109 | 10/1979 | United Kingdom . |
| 2159338 | 11/1985 | United Kingdom . |
| 2220800 | 1/1990 | United Kingdom . |
| 2222318 | 2/1990 | United Kingdom . |

*Primary Examiner*—Roscoe V. Parker

*Attorney, Agent, or Firm*—Harness, Dickey & Pierce

[57] ABSTRACT

In the construction of a motor driven tool, a bucket-shaped housing having upper and lower parts, a preassembly of a motor support, and a motor assembly including an armature and stator mounted on the support and in coaxial relation to the housing parts, and bearing means for supporting the opposite ends of the armature, respectively, in the motor support and in one said housing part, the armature being fixedly connected to the support and the stator being magnetically retained to the armature.

16 Claims, 5 Drawing Sheets

MOTOR SUPPORT FOR ORBITAL POLISHER

BACKGROUND AND SUMMARY OF THE INVENTION

This invention relates to the construction of a motor driven tool and, more particularly, to a construction which provides ease of assembly and added stability and rigidity for the resulting assembly.

Motor driven tools are typically constructed with a two-part clamshell type housing wherein the motor fits within recesses molded as part of the interior of the housing, the attachment together of the two parts of the housing acting to secure the motor therein. This form of construction can present a number of disadvantages, among which is a relatively loose containment of the motor in the housing. Such loose containment leads to a certain amount of instability for the overall tool.

It is therefore a primary object of this invention to provide a tool construction which results in enhanced stability and rigidity of the tool.

Another object is provision of a motor construction wherein the armature and stator are accurately located and accurately positioned relative to a support member.

Another object is provision of a motor support which permits preassembly of the internal components of the machine, prior to final assembly of the motor assembly to the motor housing.

The foregoing and additional objects are attained in accordance with the principles of this invention by providing a power tool comprising a two-part bucket-shaped housing, a motor preassembly connected to the housing, and means for positioning the motor assembly in coaxial relationship to each part of the housing. For the purposes of convenience, the power tool will be referred to as a hand-held orbital polisher. The motor preassembly comprises a motor support peripherally connected to the housing, an armature fixedly connected to the motor support and including an axial shaft arranged vertically and having its opposite respective ends supported for rotation in the motor support and the housing, a stator including a pair of permanent magnets, and means for positioning and retaining the stator in coaxial relation to the armature.

In accordance with a particular aspect of this invention, the housing is integrally formed to include upper and lower housing parts for enclosing the motor assembly, and the motor support is connected to a horizontal housing flange and extends transversely to the motor axis. The motor support positions, locates and aligns the motor assembly, a circuit board, a switch, and electrical wiring for assembly into the housing.

Advantageously, is the simplified assembly of the internal components of the polisher on a single unitary support. The assembly of the internal components is simple because the assembly is conducted external to the motor housing.

Further objects, advantages and features of the present invention will become more fully apparent from the detailed consideration of the arrangement and construction of the constituent parts as set forth in following description taken together with the accompanying drawings.

DETAILED DESCRIPTION OF THE PREFERRED EMBODIMENT

Figure 1:
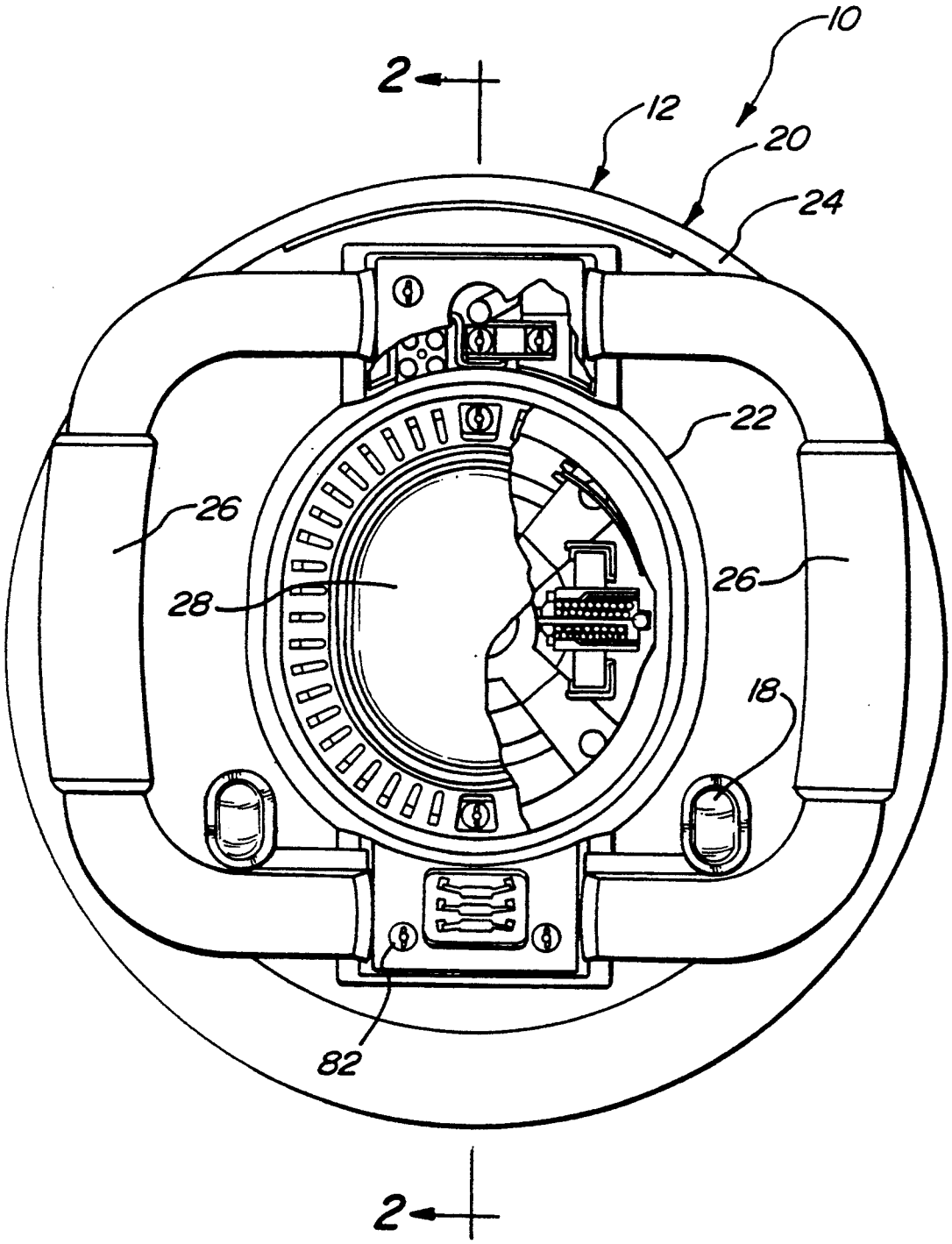
FIG. 1 is a top plan view of an orbital polisher, according to the present invention.
Figure 2:
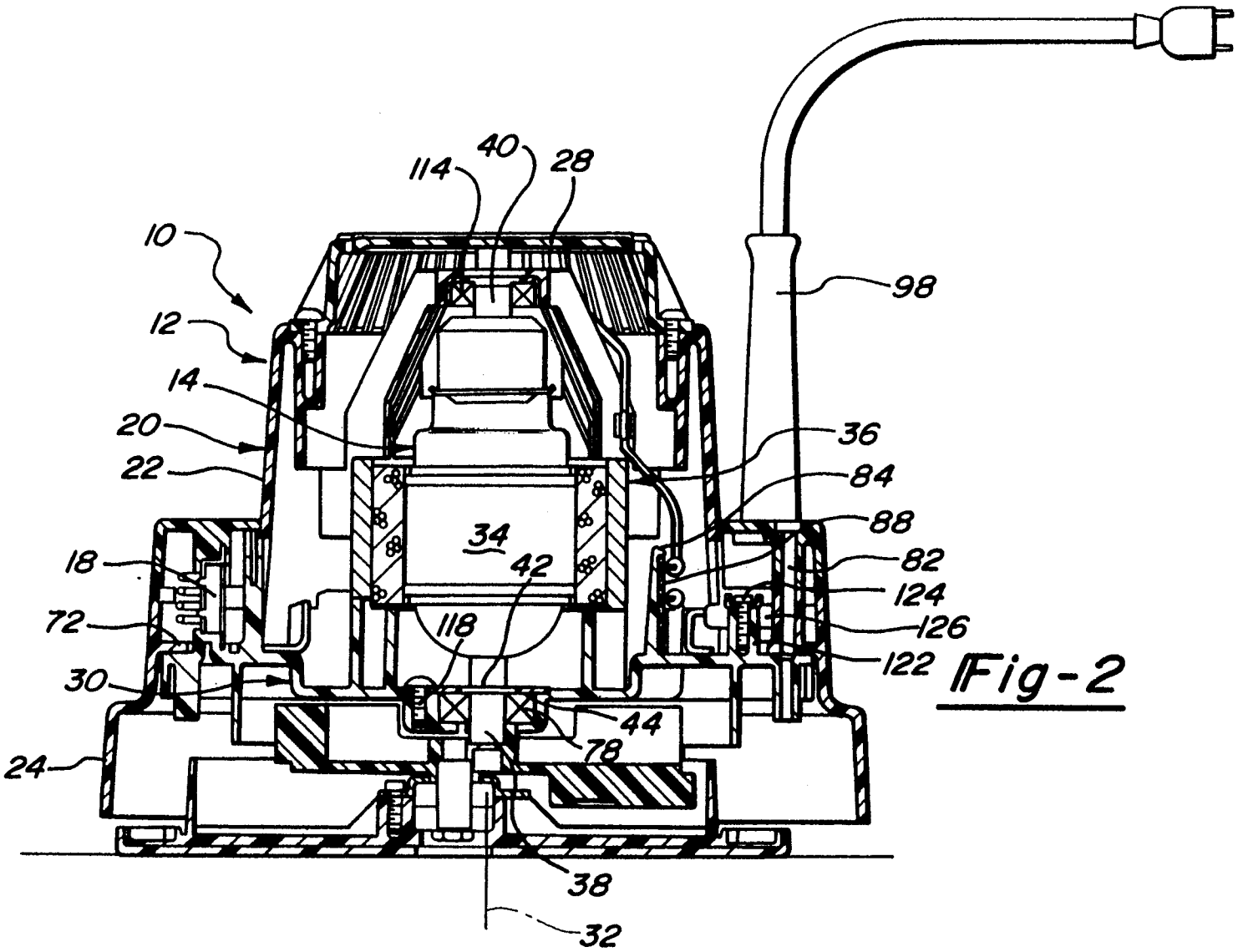
FIG. 2 is a vertical transverse cross-sectional view taken along line 2—2 of FIG. 1.
Figure 3:
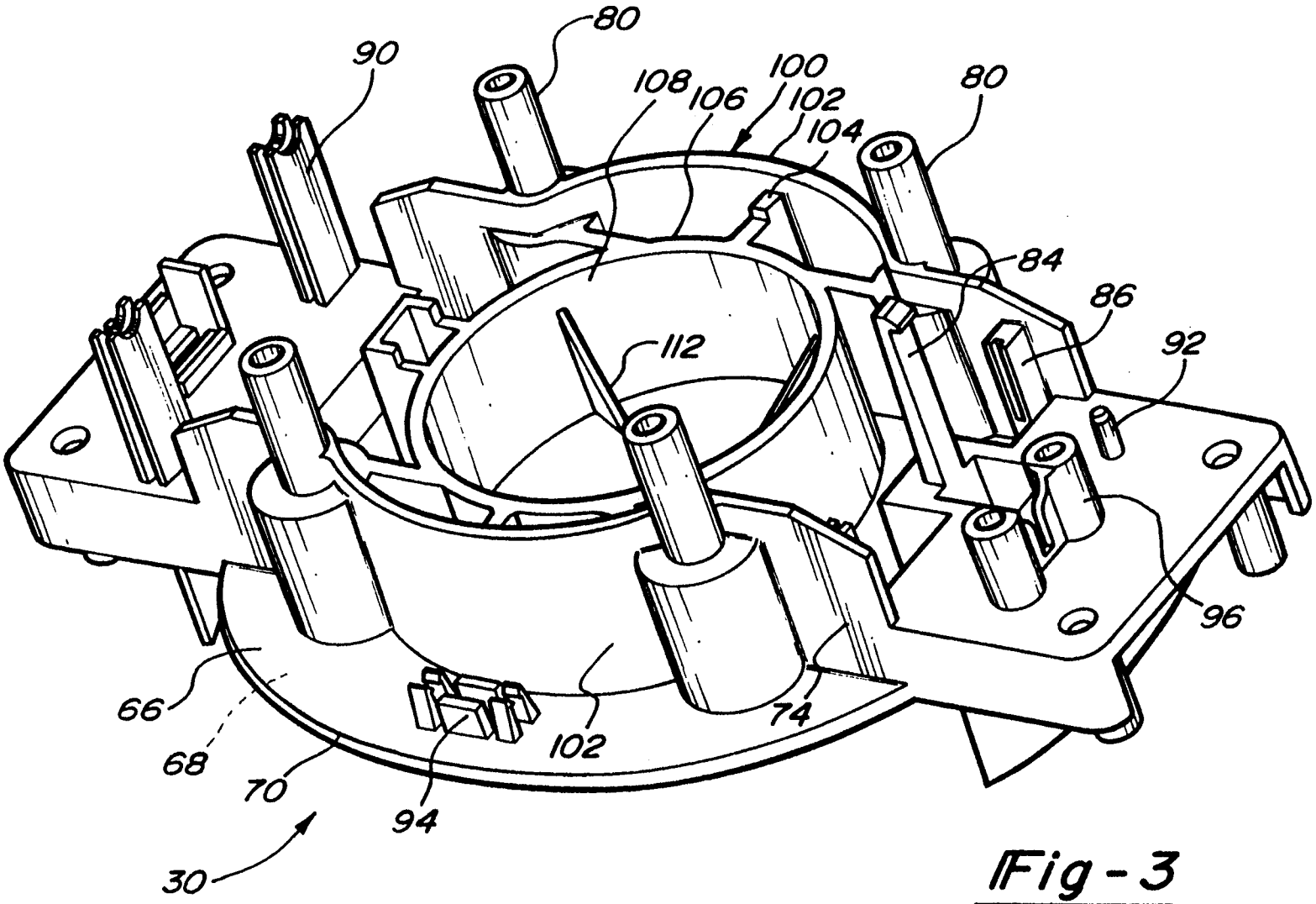
FIG. 3 is an enlarged perspective view of a motor support.
Figure 4:
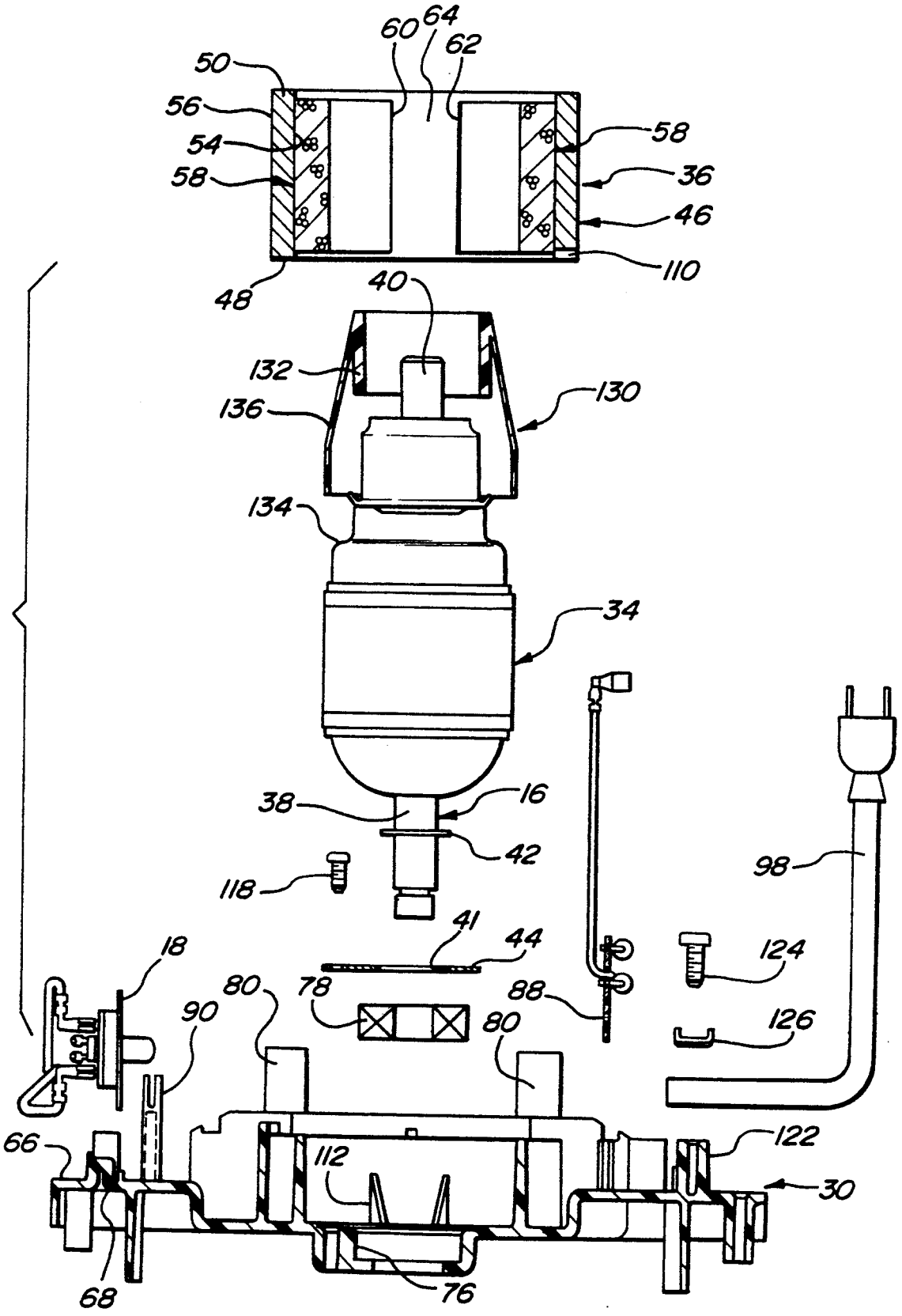
FIG. 4 is an exploded view of a motor preassembly.

Turning now to the drawings, FIGS. 1–5 illustrate a hand-held orbital polisher 10 of the type including a housing assembly 12, a permanent magnet electrical motor 14 including an axial shaft 16 to drive a surface treatment assembly (e.g., a polishing pad), and an electrical control including a switch 18 in operable relation to the motor. While these figures illustrate an exemplary preferred embodiment as applied to an orbital polisher, one skilled in the art will readily recognize from the following discussion that such illustrative embodiment is exemplary and that the motor mounting arrangement of the invention is also applicable to other power tool apparatus requiring accurate positioning of the motor.

The housing assembly 12 comprises a generally bucket-shaped motor housing 20 having upper and lower portions 22 and 24, a pair of handles 26 close connected to the motor housing to enable the user to maneuver the polisher and operate the motor switch 18, a cap 28 fixed to the top open end of the upper portion 22, and a motor support 30 for supporting all of the major internal components of the polisher. The upper and lower portions 22 and 24 are generally cylindrical, coaxially arranged vertically along a longitudinal axis 32, and coaxially arranged with the axis of the motor shaft 16, the upper portion 22 for enclosing the motor and the lower portion 24 being downwardly open and defining a skirt which encloses the polishing pad.

The motor 14 includes an armature 34 and a stator 36 concentrically aligned with the axis 32. The motor shaft 16 is centrally disposed relative to the armature 34 and has its opposite axial end portions 38 and 40 extending therefrom. The shaft end portion 38 includes an annular flange 42 sized to be received in the central opening 41 of a bearing retainer plate 44.

The stator 36 comprises a cylindrical sleeve 46 having opposite axial end faces 48 and 50 and inner and outer cylindrical walls 54 and 56, and a pair of identical semi-cylindrical magnets 58 fixedly bonded to the inner wall 54 so as to be in encircling relation to the armature. Each magnet has a pair of angularly spaced end faces 60 and 62, the end faces subtending an angle of approximately 140° whereby to form an air gap 64 between the magnets. The magnet sleeve 46 is retained on the motor armature solely due to magnetic force.

The motor support 30 comprises a generally planar plate having top and bottom surfaces 66 and 68 and an outer periphery 70, the top surface 66 being adapted to mount against an annular flange or shoulder 72 extending from the motor housing 20. The motor support 30 is integrally formed of a polymeric material and includes a base 74 for supporting and locating the motor 14, a cylindrical bearing well 76 for receiving a roller bearing 78, a series of internally threaded tubular bosses 80 for receiving mounting screws 82, a resilient latch 84 and guide 86 for retaining a printed circuit board 88, a retainer 90 for mounting the motor switch 18, a terminal block retainer 92, wire retainers 94 for positioning and retaining electrical wiring, and a wire retainer 96 for retaining and routing a power cord 98.

The motor support and locating base 74 defines a cradle 100 for supporting the end face 48 of the stator sleeve 46 and includes a pair of semi-cylindrical walls 102 for enclosing the outer wall 56 of the sleeve 46, a radial locating tab 104 for angularly locating the sleeve 46 and the permanent magnets 58 relative to the base 74, and an inner wall 106 forming a cylindrical well 108 for receiving the bottom end portion of the armature. The tab 104 is received in a notch 110 formed in the end face 48 of the sleeve 48 for accurately locating and positioning the magnets relative to the armature. Upwardly extending from the well 108 are a plurality of angled walls 112 for supporting the armature in the well 108.

The roller bearing 78 and a roller bearing 114 are provided to support the opposite respective end portions 38 and 40 of the motor shaft 16. The bearing 78 is adapted to be received in the bearing well 76 and be captivated therein by the bearing retainer plate 44, the plate 44 being secured to the motor support 30 by a fastener 118. The roller bearing 114 is received in a bearing well 120 formed in the upper housing portion 22.

To assemble the polisher, a motor preassembly is formed. The motor support 30 is located on work table and the lower roller bearing 78, switch 18, printed circuit board 88, power cord 98 and wiring are secured to the support member. The bearing 78 is positioned in the well 76 and the bearing retainer plate 44 is secured to the support member by the fastener 118, thereby captivating the bearing 78. The circuit board 88 is inserted downwardly into the guide 86, causing the latch 84 to deflect, to allow entry, and spring forward to retain the board. The power cord 98 is secured to a threaded boss 122 by a fastener 124 and clamp 126, the clamp 126 engaging the cord 98 and the fastener 124 driving the clamp downwardly against the boss 122.

The motor 14 is lowered onto the cradle 100 and the bottom portion supported on the walls 112 in the motor well 108. The shaft end portion 38 is frictionally engaged with the bearing 78 and extended through an opening in the well 108 and below the support 30. The motor is fixedly connected to the support 30 solely by the frictional engagement between the shaft and the bearing. The friction force is greater than the weight of the motor such that when the support member is turned upside down, the motor will not come out of the bearing.

Figure 5:
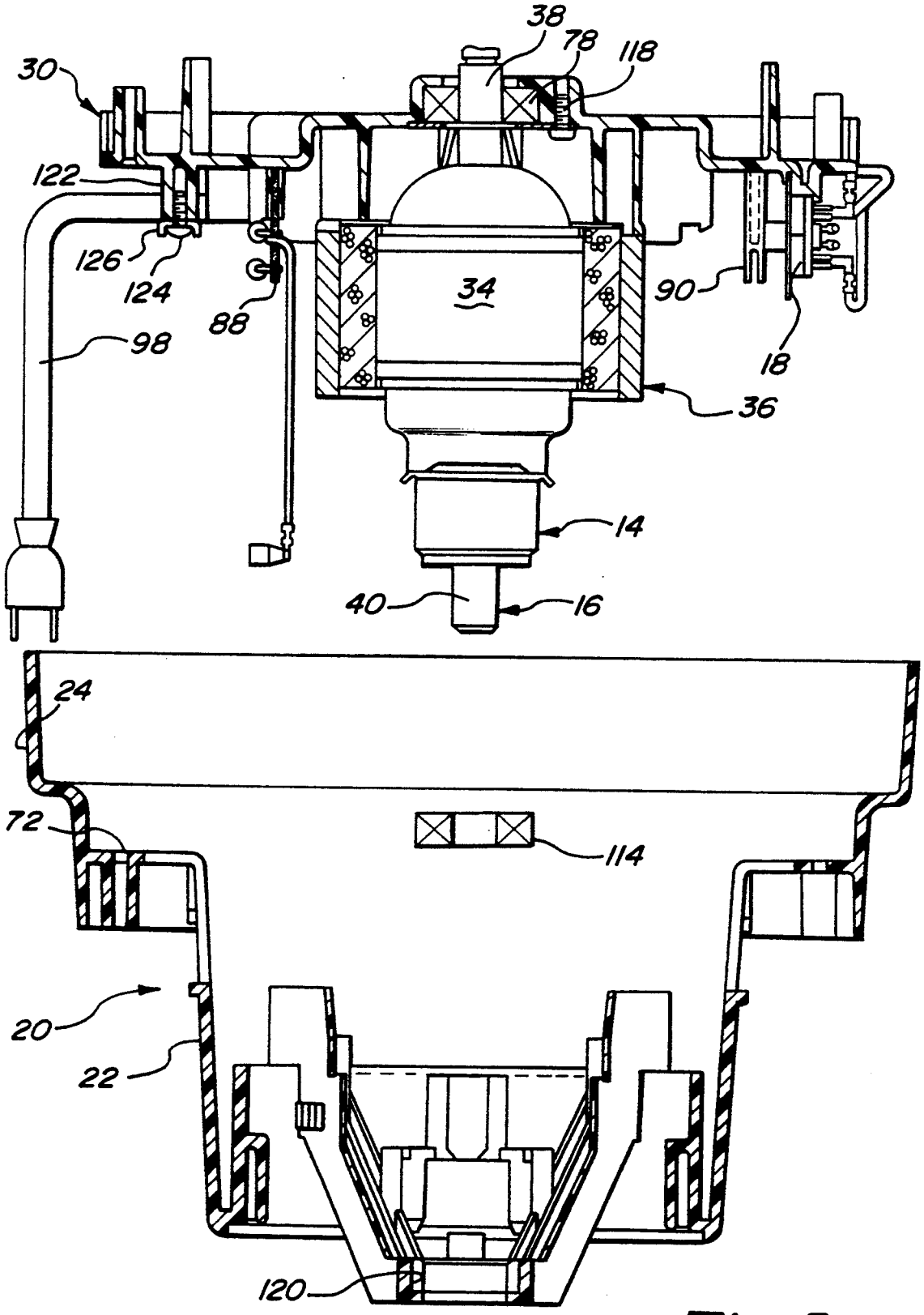
FIG. 5 is an exploded view of the motor preassembly of FIG. 4 positioned for assembly into a bucket-shaped motor housing.

As shown best in FIG. 5, motor housing 12 is turned upside down so as to be upwardly open, whereupon the upper bearing 114 is captivated in the bearing well 120 formed in the housing portion 22. The motor support 30 with the internal components preassembled thereto is turned upside down, lowered into the motor housing, upside down, and the support surface 66 peripherally seated against the flange 72. The upper end face 50 of the sleeve 46 is abutted against the upper housing portion 22. The motor support 30 is then secured to the motor housing by engaging screws with respective of the threaded screw bosses. The upper housing section cap 28 and handles 26 are then attached to the motor housing.

For assembly of the stator and armature, an insertion member 130 can be used. The insertion member includes a cylindrical sleeve 132 which is adapted to seat about an annular shoulder 134 of the armature 34, and a frustoconical sleeve portion 136 over which the magnets 58 are driven, whereby the stator sleeve 46 is coaxially positioned about the armature.

While the above description constitutes the preferred embodiment of the invention, it will be appreciated that the invention is susceptible to modification, variation, and change without departing from the proper scope or fair meaning of the accompanying claims.

What is claimed is:

1. A power tool including a motor having an armature and motor shaft rotationally supported at its opposite ends by a pair of motor bearings and electrical circuit means for controlling the application of power to the motor; the power tool further comprising:

a substantially bucket-shaped housing member forming an interior and defining a longitudinal axis and including an integrally formed first end cap located at one axial end thereof for mounting one of said pair of motor bearings for rotationally supporting one end of the motor shaft along said axis such that the motor is substantially contained within said interior, and further including an integrally formed support surface proximate the other axial end thereof; and a support member including an integrally formed second end cap for mounting the other of said pair of motor bearings for rotationally supporting the other end of the motor shaft along said axis, said support member being mounted to said support surface substantially transversely to said axis and including means for mounting said electrical circuit means thereon.

2. The power tool as claimed in claim 1 wherein the motor further includes a stator comprising a cylindrical sleeve having a pair of permanent magnets fixedly mounted thereto; and locating means, operating between the support member and stator, for positioning the magnets relative to said armature.

3. The power tool as claimed in claim 2 wherein said locating means includes an interengaging tab and notch in said support member and sleeve.

4. The power tool as claimed in claim 2 wherein said stator is mounted to said armature solely by magnetic force.

5. The power tool as claimed in claim 1 wherein said support member is integrally formed of polymeric material and said second end cap thereof includes a cradle for rotatably supporting said other end of said motor shaft.

6. The power tool as claimed in claim 5 wherein said cradle includes a cylindrical well and said other motor bearing is mounted in said well, such that said other end of said motor shaft is rotatably supported by said support member.

7. The power tool as claimed in claim 6 wherein said first end cap of said housing member includes a bearing well and said one motor bearing which receives said one end of said motor shaft is mounted in said bearing well such that said pair of motor bearings position the axis of said shaft in coaxial relation to the longitudinal axis of said housing.

8. The power tool as claimed in claim 1 wherein said electrical circuit means includes an electrical switch and a printed circuit board containing an electrical circuit for controlling the operation of said motor.

9. The power tool as claimed in claim 8 wherein said support means includes first mounting means for mounting said electrical switch to said support member and second mounting means for mounting said printed circuit board to said support member.

10. The method of assembling a power tool including a motor having an armature and a motor shaft, a pair of motor bearings, electrical circuit means for controlling the application of power to the motor, a substantially bucket-shaped housing member forming an interior and defining a longitudinal axis and including a first end cap at one axial end thereof and a peripheral support surface proximate the other axial end thereof, and a substantially planar support member having a second end cap and mounting means adapted for receiving said electrical circuit means; the method comprising the steps of:

a) mounting one of said motor bearings in said second end cap of said support member, b) inserting one end of said motor shaft into said one motor bearing so that said motor shaft is rotatably secured at said one end to said support member, c) mounting said electrical circuit means onto said mounting means on said support member, d) mounting the other of said motor bearings in said first end cap of said housing member, e) inserting the motor into the interior of said housing member, f) mounting said support member to the peripheral support surface of said housing member, and g) inserting the other end of said motor shaft into said other motor bearing such that said motor shaft is rotationally supported at one axial end by said first end cap of said housing member and at its other axial end by said second end cap of said support member.

11. The method as claimed in claim 10, wherein said housing member forms an opening for receiving said support member, and further including the step of positioning the housing member such that said opening is facing upwardly, positioning the support member generally horizontally with a mounting surface facing upwardly, the one motor bearing and electrical circuit means being mounted to the upwardly facing surface, and the inserting step e) including inverting the support member such that the mounting surface faces downwardly and into said opening.

12. The method as claimed in claim 11 wherein the step b) includes frictionally engaging said one end of the motor shaft with said bearing, the frictional force of engagement being greater than the weight of the armature whereby to inhibit unwanted removal of the armature when the support member is inverted.

13. The method of claim 10 wherein steps f) and g) are performed substantially simultaneously.

14. The method of claim 13 further including the step of coaxially locating a stator in encircling relation to the motor armature.

15. The method as claimed in claim 14 wherein the step of mounting said stator includes angularly registering permanent magnets of the stator about the armature, said stator being held to the armature on the support member/motor preassembly solely due to magnetic forces.

16. The method of claim 10 wherein the step of mounting said support member to the peripheral support surface of said housing member serves to substantially enclose said interior at said other axial end.

* * * * *